US005878836A

United States Patent [19]

Huang

[11] Patent Number: 5,878,836

[45] Date of Patent: Mar. 9, 1999

[54] STRUCTURE OF AN ESCAPING DEVICE

[76] Inventor: I-Feng Huang, P.O. Box 82-144, Taipei, Taiwan

[21] Appl. No.: 30,923

[22] Filed: Feb. 26, 1998

[51] Int. Cl.[6] ..... E06C 9/00

[52] U.S. Cl. ..... 182/86; 182/85; 182/97

[58] Field of Search ..... 182/85, 86, 93, 182/95, 97, 98, 99, 36

[56] References Cited

U.S. PATENT DOCUMENTS 3,386,531 6/1968 Sallein .

5,605,203 2/1997 Chang ..... 182/93

*Primary Examiner*—Alvin Chin-Shue

*Attorney, Agent, or Firm*—A & J

[57] ABSTRACT

An escaping device includes a main frame including a pair of vertical rods adapted to be fixedly mounted on an inner side of a wall, a pair of supporting rods horizontally mounted on the main frame and having a track, a supporting bracket mounted on the main frame, and a cable fixing rod fixedly arranged on the vertical rods, a suspending rail vertically mounted on the main frame and having a top provided with a pulley, a retractable ladder having two sides provided with two axles slidably fitted into the track of the supporting rods, the retractable ladder having a plurality of transverse rods each provided with a sleeve, a cable controlling means fastened on the supporting bracket, and a cable having an end secured to the cable fixing rod and another end extending through a bottom of the ladder, the pulley and the sleeves to connect with the cable controlling means.

1 Claim, 5 Drawing Sheets

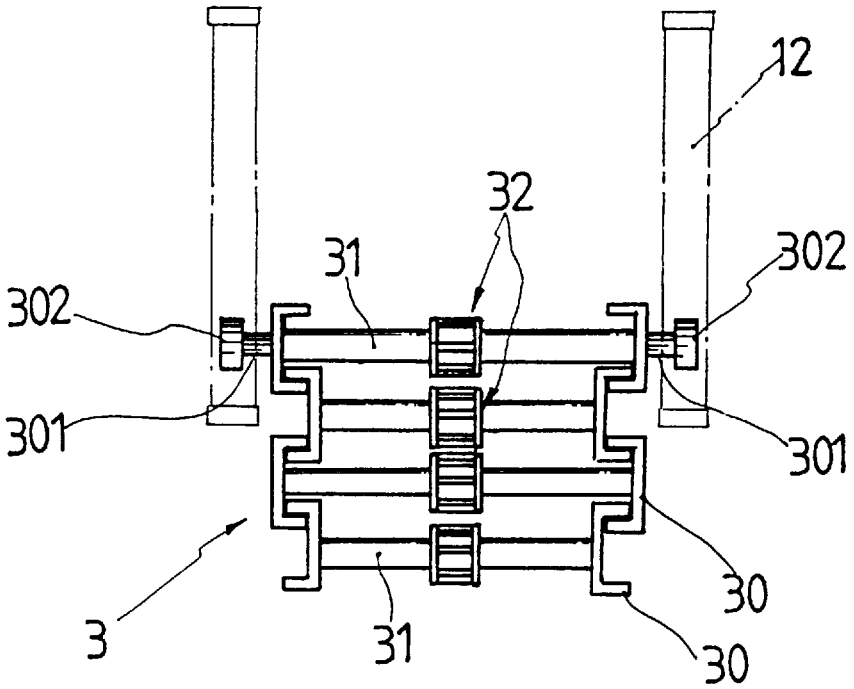
FIG. 5
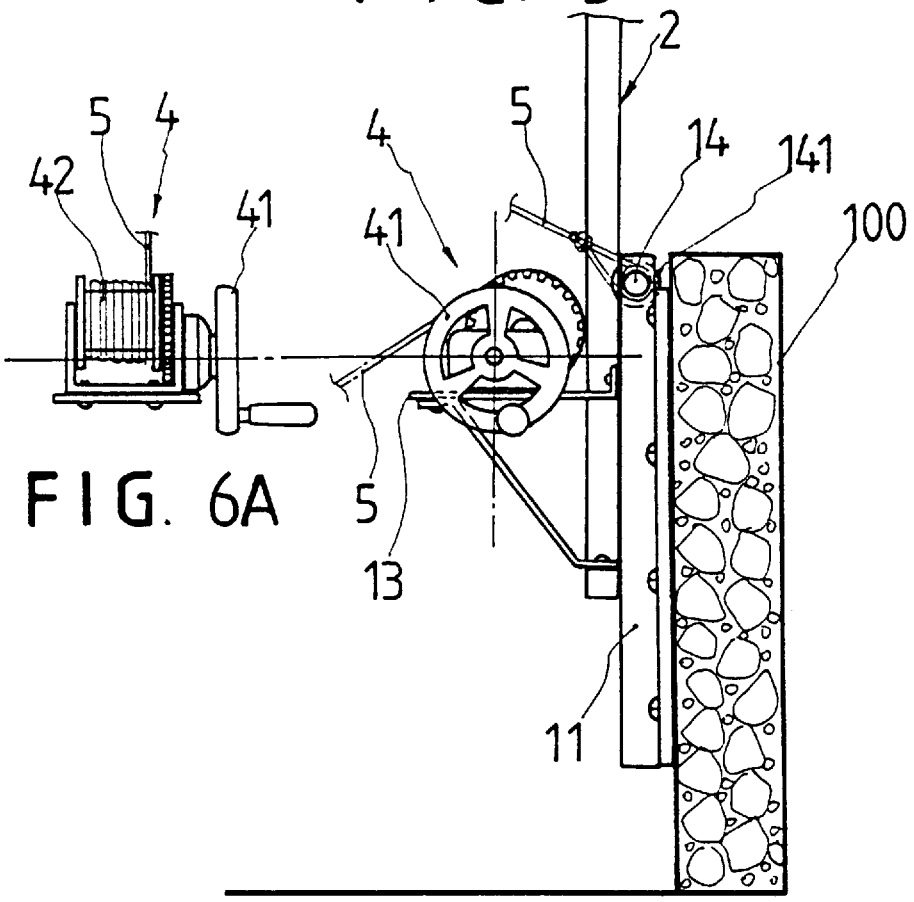
FIG. 6A
FIG. 6

STRUCTURE OF AN ESCAPING DEVICE

BACKGROUND OF THE INVENTION

1. Field of the Invention

This invention is related to an improved escaping device and in particular to one which can be easily and rapidly operated.

2. Description of the Prior Art

It has been found that the conventional escaping device is unfit for practical use and has the following drawbacks:

a. The conventional escaping device is very difficult to operate and most ordinary people cannot understand its operation in a short time and so it will be of no use in case of emergency.

b. It is necessary to have an assistant in order to operate the conventional escaping device thereby making it unfit for practical use.

c. The conventional escaping device can carry only one person at a time and this slow action cannot save a critical situation.

d. It is necessary to conquer the mental barrier in suspending in the air in addition to the terror in a fire accident thus making it infeasbile to use.

Therefore, it is an object of the present invention to provide an improvement in the structure of an escaping device which can obviate and mitigate the above-mentioned drawbacks.

SUMMARY OF THE INVENTION

This invention is related to an improved escaping device which includes a main frame including a pair of vertical rods adapted to be fixedly mounted on an inner side of a wall, a pair of supporting rods horizontally mounted on the main frame and having a track, a supporting bracket mounted on the main frame, and a cable fixing rod fixedly arranged on the vertical rods, a suspending rail vertically mounted on the main frame and having a top provided with a pulley, a retractable ladder having two sides provided with two axles slidably fitted into the track of the supporting rods, the retractable ladder having a plurality of transverse rods each provided with a sleeve, a cable controlling means fastened on the supporting bracket, and a cable having an end secured to the cable fixing rod and another end extending through a bottom of the ladder, the pulley and the sleeves to connect with the cable controlling means.

It is the primary object of the present invention to provide an improved escaping device which is safe in operation.

It is another object of the present invention to provide an improved escaping device which is simple in construction.

It is still another object of the present invention to provide an improved escaping device which is easy to install.

It is still another object of the present invention to provide an improved escaping device which is low in cost.

It is a further object of the present invention to provide an improved escaping device which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 5 illustrates the engagement between the sections of the ladder;

FIG. 6 illustrates the relationship between the cable controlling mechanism and the cable fixing rod;

FIG. 6A is a side view of the cable controlling mechanism;

DETAILE DESCRIPTION OF THE PREFERRED EMBODIMENT

Figures 1, 1A, 1B:
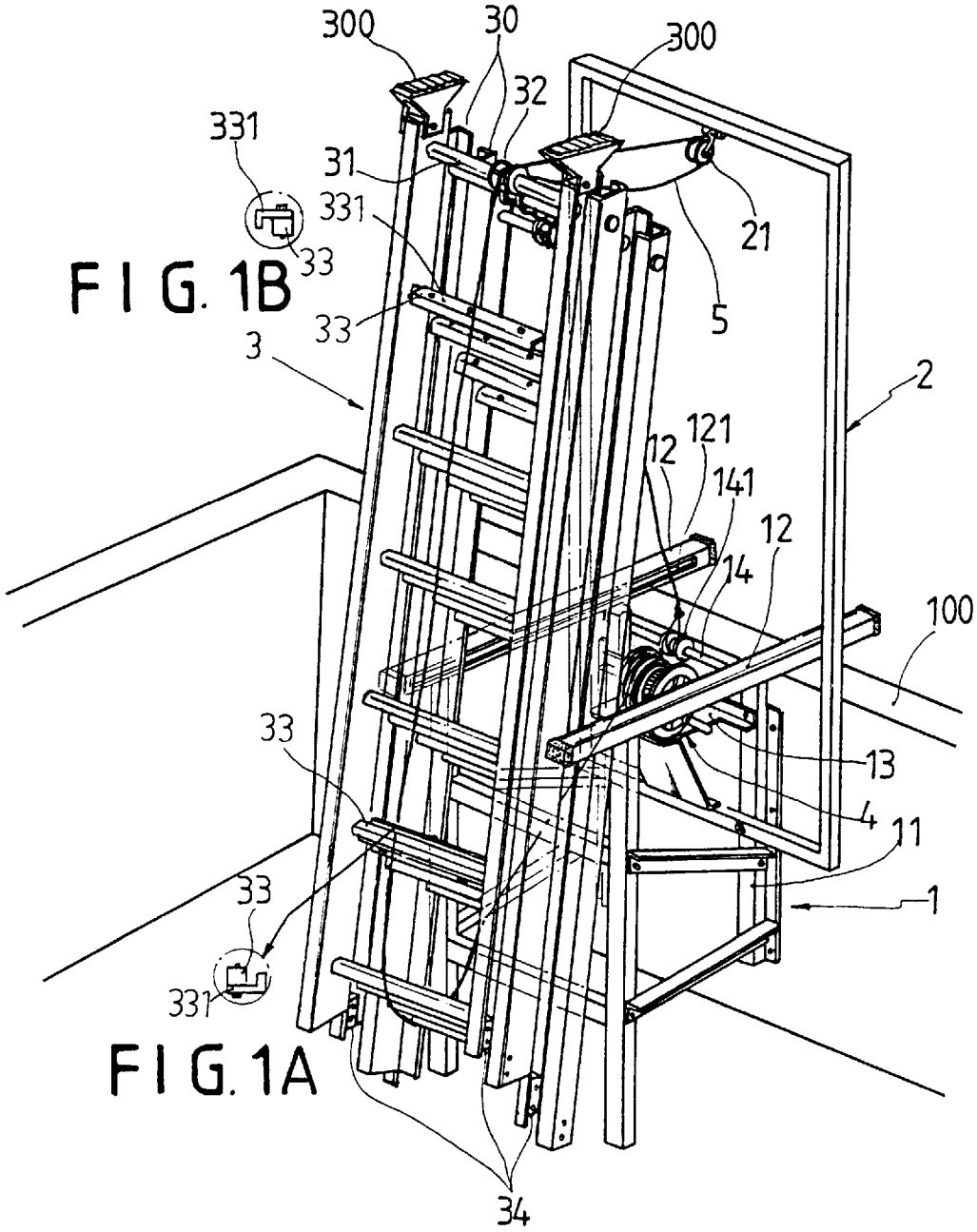
FIG. 1 is a perspective view of the present invention.
FIG. 1A is an enlarged fragmentary view of FIG. 1.
FIG. 1B is an enlarged fragmentary view of FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the escaping device according to the present invention generally comprises a main frame 1, a suspending rail 2, a ladder 3, a cable controlling mechanism 4 and a cable 5. The main frame 1 essentially includes a pair of inner side rods 11, a pair of supporting rods 12, a supporting bracket 13, and a cable fixing rod 14. The inner side rods 11 are designed to be fixedly mounted on the inner side of a wall 100. The supporting rods 12 are horizontally mounted on the main frame 1 and provided with tracks 121 for guiding the movement of the ladder 3. Further, the supporting rods 12 extend outwardly beyond the wall 100.

Referring to FIGS. 1, 6 and 6A, the supporting bracket 13 is horizontally arranged within the main frame 1, on which is fastened the cable controlling mechanism 4. The cable fixing rod 14 is disposed in front of the supporting bracket 13 and has two lugs 141 at the intermdiate portion between which is mounted an end of the cable 5.

Referring to FIG. 1 again, the suspending rail 2 is vertically mounted on the main frame 1 and provided on the top with a pulley 21 for the passage of the cable 5.

Figure 2:
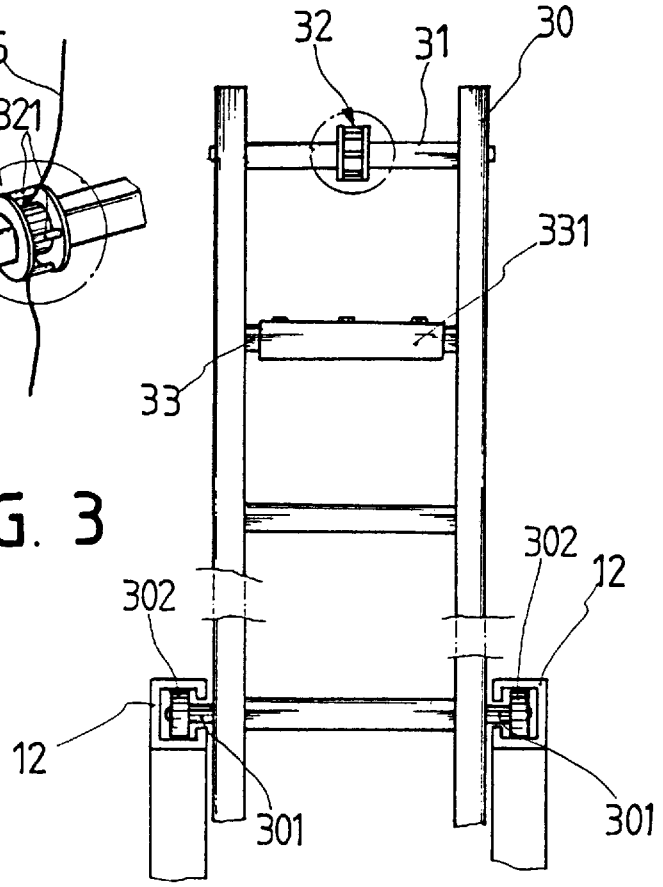
FIG. 2 illustrates the structure of the ladder.
Figure 4:
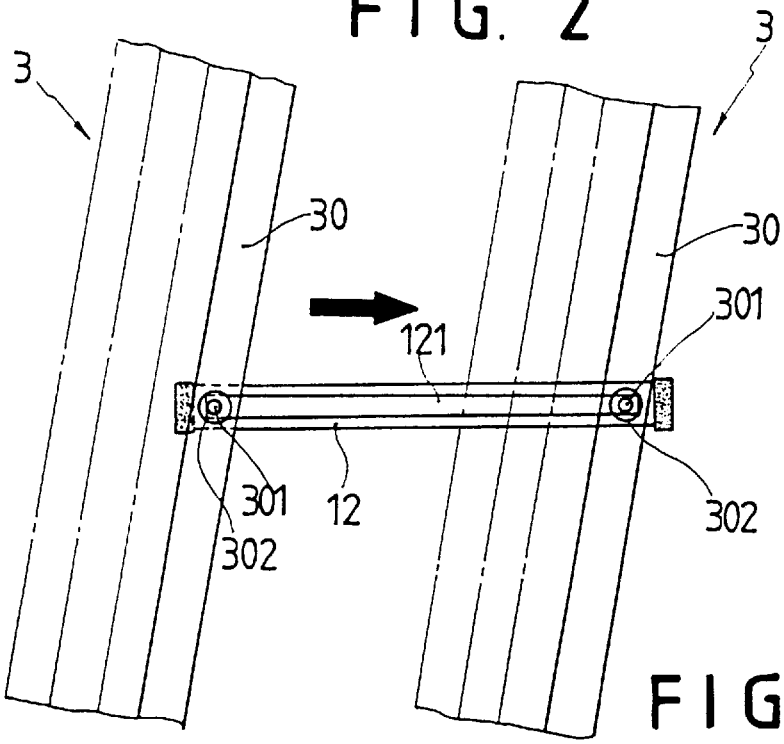
FIG. 4 illustrates how the ladder is moved along the supporting rod.

As shown in FIGS. 2 and 5, the ladder 3 is provided with a plurality of sections 30. Two sides of one of the sections 30 are provided with two axles 301 each having a roller 302 adapted to be fitted into the track 121 of the supporting rod 12 so that the ladder 3 can be moved to and fro (see FIG. 4) or overturned (see FIGS. 7 and 8) as required. Furthermore, the top of the last section 30 has a leg 300 for stabilizing the ladder 3 (see FIGS. 7 and 8).

Figure 3:
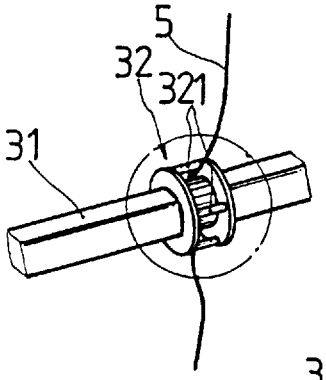
FIG. 3 is an enlarged perspective view showing the structure of the sleeve.

The ladder 3 is composed of a plurality of sections 30 which are slidably joined together (see FIG. 5) so that the ladder 3 can be extended or retracted as required. The first transverse rod 31 of the each section 30 is provided with a sleeve 32 for guiding the passage of the cable 5 so that the cable 5 can be used for controlling the sections 30. As illustrated in FIG. 3, the sleeve 32 is a circular member which is rotatable with respect to the transverse rod 31. The sleeve 32 has a plurality of pins 321 for positioning the cable 5 and preventing the cable 5 from moving out of the sleeve 32. A L-shaped member 331 (see FIGS. 1, 1A, 1B and 2) is secured to the lower transverse rod 33 of the section 30, and an inverted L-shaped member 331 is fastened to the upper transverse rod 33 of the section 30, so that two sections 30 can be firmly engaged with each other when the sections 30 are extended (see FIGS. 1, 1A, 1B, 2 and 8). Also, when a section 30 is retracted upwardly, the section 30 will be blocked by a stopper 34 mounted at the bottom of each section 30.

Looking now at FIG. 6, the cable controlling mechanism 4 is provided with a hand wheel 41 for controlling the cable 5 and the operation of the ladder 3. The cable controlling mechanism 4 is provided with a braking device (not shown) which will stop the cable controlling mechanism 4 if there is no external force applied thereto. The braking device is well known to those skilled in the art and not considered a part of the invention.

Figure 7:
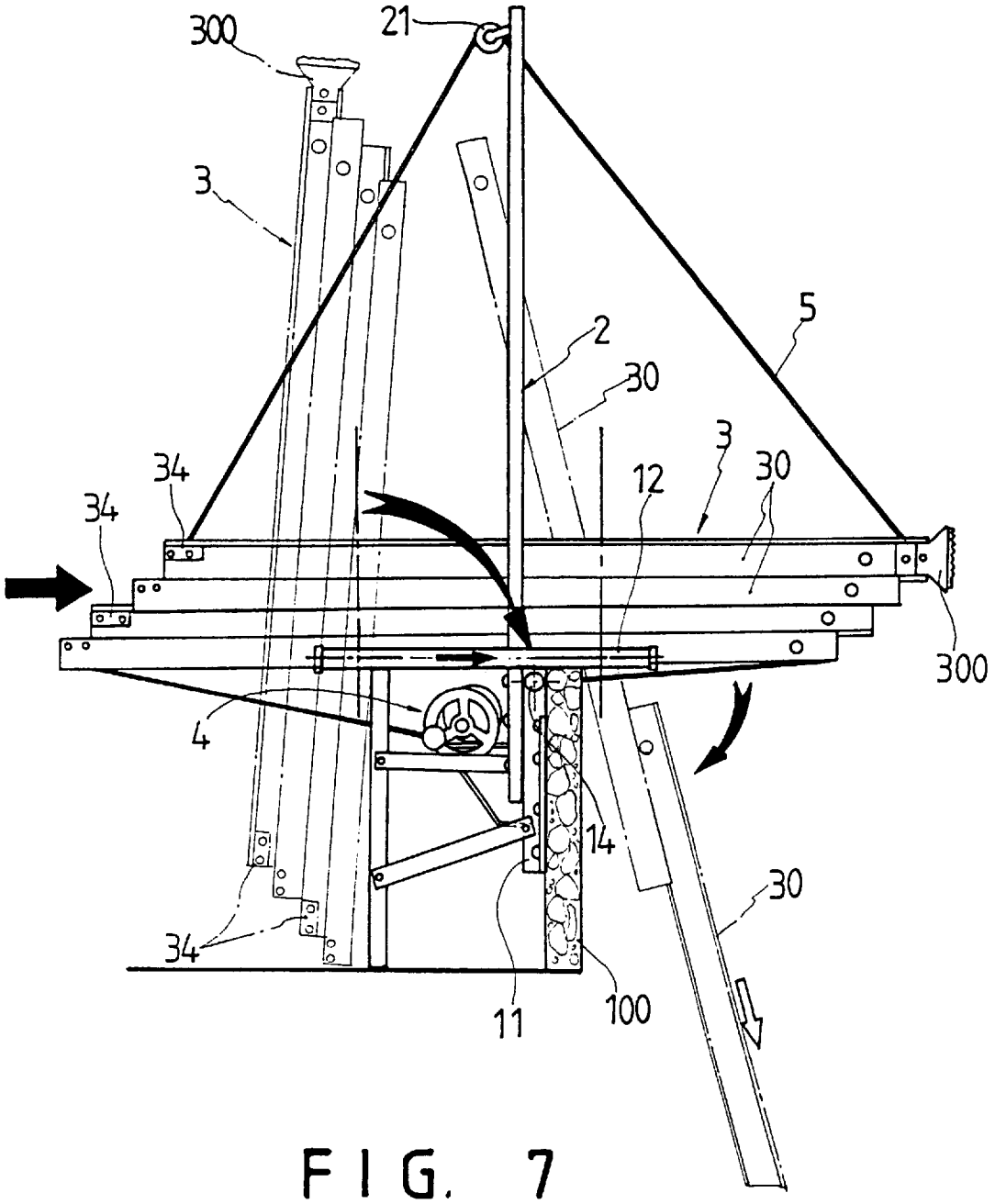
FIG. 7 is a side view showing the operation of the present invention.
Figure 8:
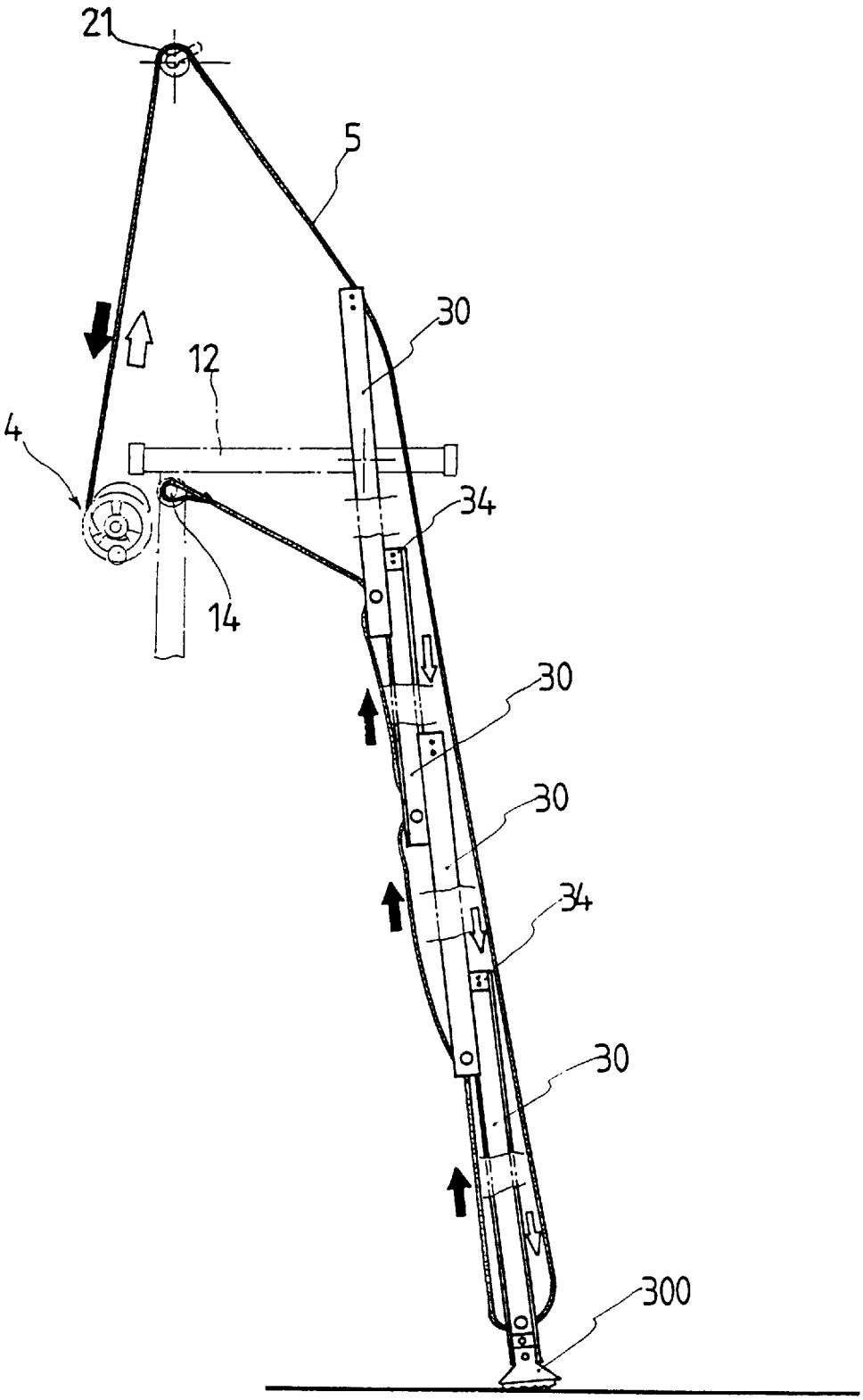
FIG. 8 is another side view showing the operation of the present invention.

Referring to FIG. 7, an end of the cable 5 is connected to the cable controlling mechanism 4 and the other end of the cable 5 extends through the bottom of the ladder 3, the pulley 21 and the sleeves 32 to connect with the cable fixing rod 14.

When in use, the ladder 3 is first rotated to the horizontal position and then moved forwardly to turn beyond the wall 100. Thereafter, the cable controlling mechanism 4 is rotated to lower the ladder to the ground.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An escaping device comprising:

a main frame including a pair of vertical rods adapted to be fixedly mounted on an inner side of a wall, a pair of supporting rods horizontally mounted on said main frame and having a track, a supporting bracket mounted on said main frame, and a cable fixing rod fixedly arranged on said vertical rods;

a suspending rail vertically mounted on said main frame and having a top provided with a pulley;

a retractable ladder having two sides provided with two axles slidably fitted into said track of said supporting rods, said retractable ladder having a plurality of transverse rods each provided with a sleeve;

a cable controlling means fastened on said supporting bracket; and a cable having an end secured to said cable fixing rod and another end extending through a bottom of said ladder, said pulley and said sleeves to connect with said cable controlling means.

* * * * *